US009689223B2

(12) United States Patent
Schacherer et al.

(10) Patent No.: US 9,689,223 B2
(45) **Date of Patent: *Jun. 27, 2017**

(54) SELECTABLE, INTERNALLY ORIENTED AND/OR INTEGRALLY TRANSPORTABLE EXPLOSIVE ASSEMBLIES

(75) Inventors: Timothy G. Schacherer, Lewisville, TX (US); Marvin G. Batres, Cypress, TX (US); Tommy Thammavongsa, Houston, TX (US); Randall S. Moore, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 401 days.

This patent is subject to a terminal disclaimer.

(21) Appl. No.: 13/078,423

(22) Filed: Apr. 1, 2011

(65) Prior Publication Data

US 2012/0247769 A1 Oct. 4, 2012

(51) Int. Cl.
*E21B 29/02* (2006.01)
*E21B 43/116* (2006.01)
(Continued)

(52) U.S. Cl.
CPC ..... *E21B 29/02* (2013.01); *E21B 43/116* (2013.01); *E21B 43/117* (2013.01); *E21B 43/119* (2013.01); *E21B 43/1185* (2013.01)

(58) Field of Classification Search
CPC ..... E21B 29/02; E21B 43/116; E21B 43/117; E21B 43/1185; E21B 43/119; E21B 43/118
(Continued)

(56) References Cited

U.S. PATENT DOCUMENTS 2,833,213 A 5/1958 Udry
2,980,017 A 4/1961 Castel
(Continued)

FOREIGN PATENT DOCUMENTS

EP 2072751 A2 6/2009
GB 2374887 A 10/2002
(Continued)

OTHER PUBLICATIONS

Office Action issued Sep. 8, 2009, for U.S. Appl. No. 11/957,541, 10 pages.

(Continued)

*Primary Examiner* — Wei Wang
(74) *Attorney, Agent, or Firm* — Chamberlain Hrdlicka

(57) ABSTRACT

A system can include multiple explosive assemblies, each assembly comprising an outer housing, an explosive component rotatable relative to the housing, and a selective firing module which causes detonation of the component in response to a predetermined signal. A method can include assembling multiple explosive assemblies at a location remote from a well, installing a selective firing module, an electrical detonator and an explosive component in a connector, and connecting the connector to an outer housing, and then transporting the assemblies from the remote location to the well. A well perforating method can include assembling multiple perforating guns, each gun comprising a gun body, a perforating charge, and a selective firing module which causes detonation of the charge in response to a predetermined signal. The guns are installed in a wellbore, with the charge of each gun rotating relative to the respective gun body.

23 Claims, 9 Drawing Sheets

(51) Int. Cl.
*E21B 43/119* (2006.01)
*E21B 43/117* (2006.01)
*E21B 43/1185* (2006.01)

(58) Field of Classification Search
USPC .... 166/297, 298, 299, 250.1, 55, 55.1, 55.6, 166/55.7; 175/4.53; 102/306, 307, 310, 102/313, 320; 89/1.15
See application file for complete search history.

(56) References Cited

U.S. PATENT DOCUMENTS

| | | | | |
|---|---|---|---|---|
| 3,273,645 | A * | 9/1966 | Der Mott | 166/55.1 |
| 3,414,071 | A | 12/1968 | Alberts | |
| 3,599,719 | A | 8/1971 | Brown | |
| 4,319,526 | A | 3/1982 | DerMott | |
| 4,410,051 | A | 10/1983 | Daniel et al. | |
| 4,637,478 | A | 1/1987 | George | |
| 4,830,120 | A | 5/1989 | Stout | |
| 5,027,708 | A | 7/1991 | Gonzalez et al. | |
| 5,103,912 | A | 4/1992 | Flint | |
| 5,107,927 | A | 4/1992 | Whiteley et al. | |
| 5,287,924 | A | 2/1994 | Burleson et al. | |
| 5,529,127 | A | 6/1996 | Burleson et al. | |
| 5,598,894 | A | 2/1997 | Burleson et al. | |
| 5,603,379 | A | 2/1997 | Henke et al. | |
| 5,823,266 | A | 10/1998 | Burleson et al. | |
| 5,957,209 | A | 9/1999 | Burleson et al. | |
| 5,964,294 | A * | 10/1999 | Edwards | E21B 17/05 166/242.6 |
| 5,992,523 | A | 11/1999 | Burleson et al. | |
| 6,397,752 | B1 | 6/2002 | Yang et al. | |
| 6,543,538 | B2 | 4/2003 | Tolman et al. | |
| 6,595,290 | B2 | 7/2003 | George et al. | |
| 6,672,405 | B2 | 1/2004 | Tolman et al. | |
| 6,679,327 | B2 | 1/2004 | Sloan et al. | |
| 7,000,699 | B2 | 2/2006 | Yang et al. | |
| 7,114,564 | B2 | 10/2006 | Parrott et al. | |
| 7,565,927 | B2 * | 7/2009 | Gerez | E21B 43/116 166/250.01 |
| 7,762,331 | B2 | 7/2010 | Goodman et al. | |
| 8,181,718 | B2 | 5/2012 | Burleson et al. | |
| 8,186,259 | B2 | 5/2012 | Burleson et al. | |
| 2004/0206503 | A1 | 10/2004 | Bell et al. | |
| 2008/0149338 | A1 | 6/2008 | Goodman et al. | |
| 2008/0202325 | A1 | 8/2008 | Bertoja et al. | |
| 2009/0159283 | A1 | 6/2009 | Fuller et al. | |
| 2009/0223400 | A1 | 9/2009 | Hill et al. | |
| 2009/0272529 | A1 | 11/2009 | Crawford | |
| 2010/0085210 | A1 | 4/2010 | Bonavides et al. | |
| 2010/0230163 | A1 | 9/2010 | Hales et al. | |
| 2011/0024116 | A1 * | 2/2011 | McCann et al. | 166/297 |

FOREIGN PATENT DOCUMENTS

| | | | |
|---|---|---|---|
| WO | 2008098052 | A2 | 8/2008 |
| WO | 2010104634 | A2 | 9/2010 |

OTHER PUBLICATIONS

Office Action issued Feb. 2, 2010, for U.S. Appl. No. 11/957,541, 8 pages.
Office Action issued Jul. 15, 2010, for U.S. Appl. No. 11/957,541, 6 pages.
Office Action issued Nov. 22, 2010, for U.S. Appl. No. 11/957,541, 6 pages.
Office Action issued May 4, 2011, for U.S. Appl. No. 11/957,541, 9 pages.
Office Action issued Apr. 21, 2011, for U.S. Appl. No. 13/008,075, 9 pages.
Office Action issued Oct. 24, 2011 for U.S. Appl. No. 11/957,541, 6 pages.
Office Action issued Oct. 24, 2011 for U.S. Appl. No. 13/008,075, 6 pages.
Search Report issued Oct. 23, 2012 for International Application PCT/US12/29895, 6 pages.
Written Opinion issued Oct. 23, 2012 for International Application PCT/US12/29895, 4 pages.
Office Action issued Apr. 21, 2011 for U.S. Appl. No. 13/008,075, 9 pages.
Office Action issued May 4, 2011 for U.S. Appl. No. 11/957,541, 9 pages.
Specification and Drawings for U.S. Appl. No. 13/750,786, filed Jan. 25, 2013, 42 pages.
Advisory Action issued Jan. 11, 2012 for U.S. Appl. No. 11/957,541, 7 pages.
Australian Examination Report issued Jan. 3, 2013 for Australian Patent Application No. 2010365400, 3 pages.
Office Action issued Mar. 6, 2013 for U.S. Appl. No. 13/750,786, 20 pages.
Office Action issued Jun. 19, 2013 for U.S. Appl. No. 13/750,786, 28 pages.
Extended European Search Report Issued in Corresponding Application No. 12763957.3, Dated Oct. 14, 2015 (6 Pages).
Advisory Action issued Aug. 27, 2013 for U.S. Appl. No. 13/750,786, 3 pages.

* cited by examiner

SELECTABLE, INTERNALLY ORIENTED AND/OR INTEGRALLY TRANSPORTABLE EXPLOSIVE ASSEMBLIES

BACKGROUND

This disclosure relates generally to equipment utilized and operations performed in conjunction with a subterranean well and, in an example described below, more particularly provides for selectable, internally oriented and/or integrally transportable explosive assemblies.

Perforating guns are typically assembled at a wellsite. Generally, perforating guns are not transported to a wellsite with an electrical detonator coupled to a detonating cord.

In addition, it is known to internally orient perforating charges relative to an outer gun body. It is also known to selectively fire perforating guns.

It will be appreciated that improvements are continually needed in the art of providing explosive assemblies for use in conjunction with subterranean wells.

SUMMARY

In the disclosure below, systems and methods are provided which bring improvements to the art. One example is described below in which an explosive assembly can be transported to a well location with an electrical detonator coupled to an explosive component. Another example is described below in which internally rotatable explosive components can be used with a selective firing module in each of multiple explosive assemblies.

The disclosure describes a well tool system which can include multiple explosive assemblies. Each explosive assembly can include an outer housing, at least one explosive component which rotates relative to the outer housing when the explosive assembly is installed in a well, and a selective firing module which causes detonation of the explosive component in response to a predetermined signal associated with the selective firing module.

A method of delivering a well tool system into a wellbore at a well location is also described below. The method can include assembling multiple explosive assemblies at a location remote from the well location, with the assembling comprising: installing an electrical detonator and an explosive component in a connector, and connecting the connector to an outer housing. After assembling, the explosive assemblies are transported from the remote location to the well location.

The disclosure below describes a well perforating method which can include assembling multiple perforating guns, each perforating gun comprising an outer gun body, at least one perforating charge which rotates relative to the outer gun body, and a selective firing module which causes detonation of the perforating charge in response to a predetermined signal associated with the selective firing module. The perforating guns are installed in the wellbore, with the perforating charge of each perforating gun rotating relative to the respective outer gun body during installation.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
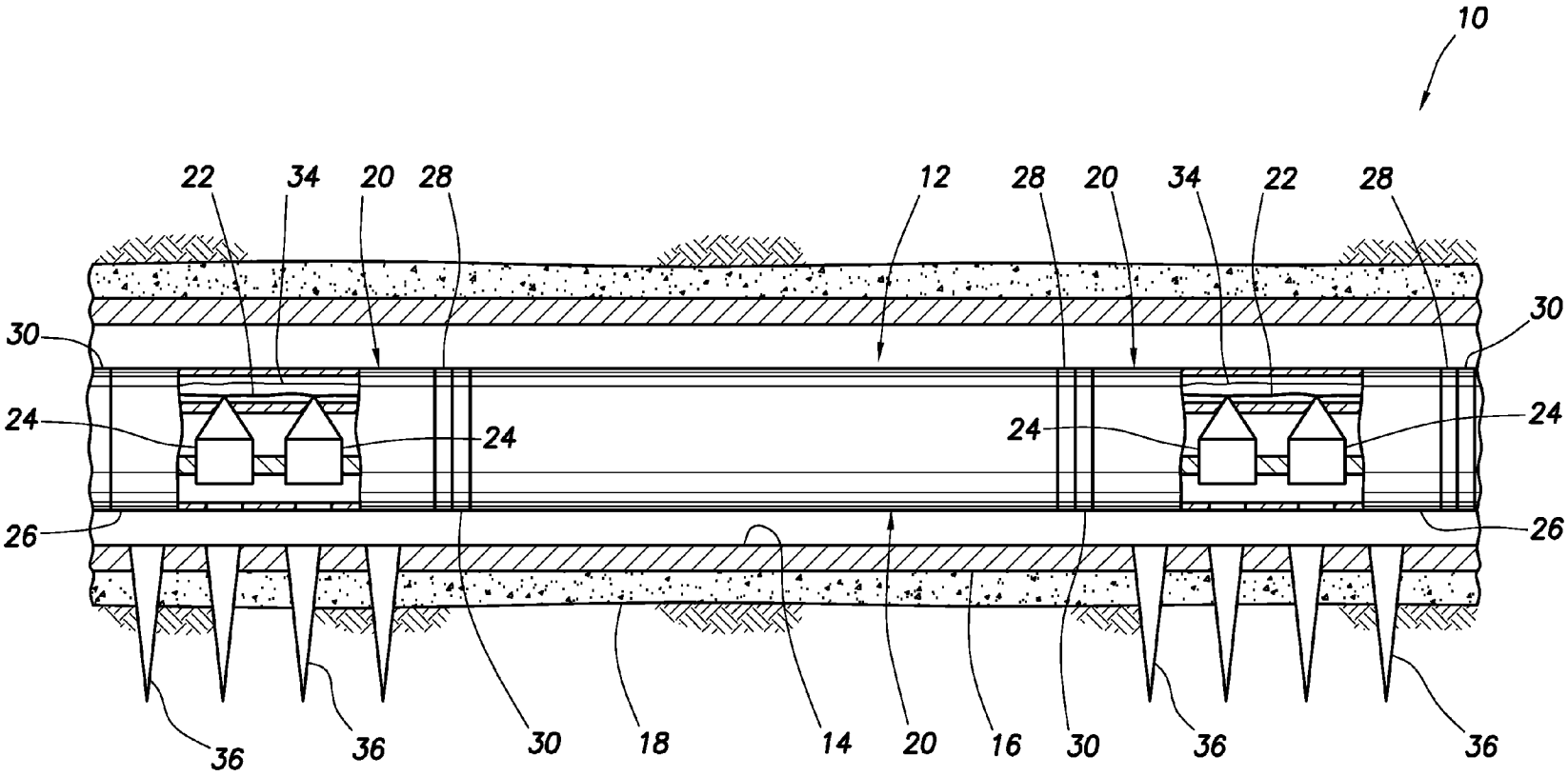
FIG. 1 is a representative partially cross-sectional view of a well system and associated method which can embody principles of this disclosure.

Representatively illustrated in FIG. 1 is a well system 10 and associated method which can embody principles of this disclosure. As depicted in FIG. 1, a well tool system 12 has been installed in a wellbore 14 lined with casing 16 and cement 18.

The well tool system 12 includes interconnected explosive assemblies 20, each of which comprises explosive components 22, 24 that are rotatable within an outer housing 26. The explosive assemblies 20 are interconnected to each other via connectors 28, 30.

In the example of FIG. 1, the explosive assemblies 20 are perforating guns, the explosive components 22, 24 are detonating cords and perforating charges, respectively, and the outer housings 26 are outer gun bodies. However, in other examples, other types of explosive assemblies could be used.

For example, the explosive assemblies 20 could instead be used for explosively severing pipe, explosively fracturing an earth formation, etc. Therefore, it should be clearly understood that the well system 10 is depicted in the drawings and is described herein as merely one example of a variety of potential uses for the principles of this disclosure, and those principles are not limited in any manner to the details of the well system 10.

In the well system 10 as depicted in FIG. 1, the explosive assemblies 20 can be selectively fired, that is, each explosive assembly can be fired individually, at the same time as, or at different times from, firing one or more of the other explosive assemblies. For this purpose, each explosive assembly 20 includes a selective firing module 32 (not visible in FIG. 1, see FIGS. 2, 4-7 & 9) and electrical conductors 34 extending along the explosive assemblies.

The electrical conductors 34 (e.g., wires, conductive ribbons or traces, etc.) electrically connect the selective firing modules 32 to a source (e.g., a wireline, a telemetry transceiver, etc.) of an electrical signal. Preferably, each selective firing module 32 is individually addressable (e.g., with each module having a unique IP address), so that a predetermined signal will cause firing of a respective selected one of the explosive assemblies. However, multiple modules 32 could respond to the same signal to cause firing of associated explosive assemblies 20 in keeping with the scope of this disclosure.

Suitable ways of constructing and utilizing selective firing modules are described in U.S. Publication Nos. 2009/0272529 and 2010/0085210, the entire disclosures of which are incorporated herein by this reference. An INTELLIGENT FIRING SYSTEM™ marketed by Halliburton Energy Services, Inc. of Houston, Tex. USA includes a suitable selective firing module for use in the well system 10.

In another unique feature of the well system 10, the explosive components 22, 24 rotate within the outer housings 26 as the explosive assemblies 20 are being installed in the wellbore 14. In the example of FIG. 1, the explosive components 22, 24 are rotated by force of gravity, so that the explosive components are oriented in a desired direction relative to vertical.

As depicted in FIG. 1, the perforating charges are oriented downward, so that perforations 36 are formed downward through the casing 16 and cement 18. However, in other examples, the perforating charges could be oriented upward or in any other direction, in keeping with the scope of this disclosure.

One suitable way of rotationally mounting the explosive components 22, 24 in the outer housing 26 is described in U.S. Publication No. 2009/0151588, or in International Publication No. WO 2008/098052, the entire disclosures of which are incorporated herein by this reference. A G-FORCE™ perforating gun marketed by Halliburton Energy Services, Inc. of Houston, Tex. USA utilizes a similar gravitationally oriented internal assembly.

Yet another unique feature of the system 10 and associated method is that the explosive assemblies 20 can be transported to a well location with each explosive assembly being already assembled. An electrical detonator 38 (not visible in FIG. 1, see FIGS. 2, 4-7 & 9) can be coupled to an explosive component 40 in each of the connectors 30 in the assembly stage, prior to transporting the explosive assemblies 20 to the well location. After arrival at the well location, the explosive assemblies 20 can be installed in the wellbore 14, without a necessity of coupling the electrical detonator 38 to the explosive component 40 at the well location. This saves time and labor at the well location, where both of these commodities are generally at a premium.

Although the well system 10 is described herein as including several unique features, it should be understood that it is not necessary for a well system incorporating the principles of this disclosure to include all of those features. Instead, a well system could, within the scope of this disclosure, incorporate only one, or any combination, of the features described herein.

Figure 2:
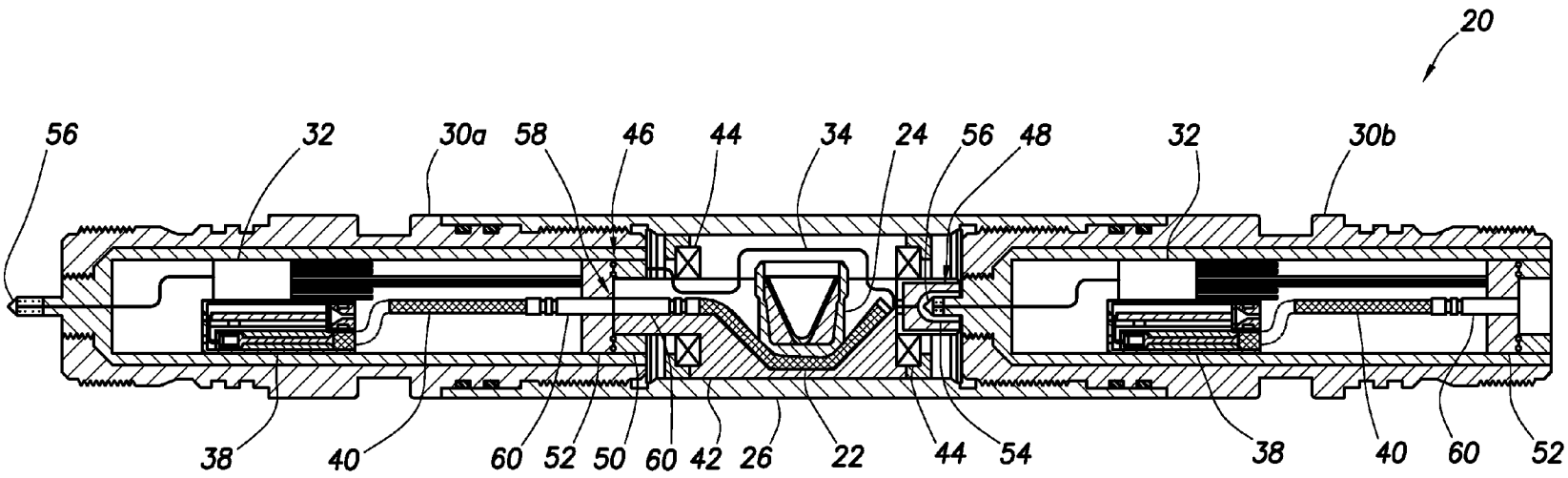
FIG. 2 is a representative cross-sectional view of an explosive assembly which may be used in the well system and method, and which can embody principles of this disclosure.

Referring additionally now to FIG. 2, another configuration of the explosive assembly 20 is representatively illustrated. The explosive assembly 20 configuration of FIG. 2 may be used in the well system 10 of FIG. 1, or it may be used in other well systems.

In the FIG. 2 configuration, the explosive assembly 20 includes only one of the explosive component 24. However, in other examples, multiple explosive components 24 could be used in the outer housing 26.

Another difference between the FIGS. 1 & 2 configurations is that the explosive component 24 in the FIG. 2 configuration is oriented upward, due to its mounting to an eccentric weight 42, and being supported on bearings 44. Any orientation of the explosive component 24 may be used in keeping with the scope of this disclosure.

The explosive components 22, 24, eccentric weight 42 and bearings 44 are positioned in the outer housing 26 between two connectors 30*a,b* (the connectors 28 are not necessarily used in the FIG. 2 configuration). Each of the connectors 30*a,b* is threaded into a respective end of the outer housing 26.

The electrical conductor 34 is electrically connected to the selective firing modules 32 in the connectors 30*a,b* via rotary electrical connections 46, 48. The rotary electrical connections 46, 48 are used, because the electrical conductor 34 rotates along with the explosive components 22, 24, eccentric weight 42, etc., within the outer housing 26. In other examples, the electrical conductor 34 may not rotate within the outer housing 26, in which case the rotary electrical connections 46, 48 may not be used.

The rotary electrical connection 46 comprises an electrical contact 50 which rotates with the explosive components 22, 24. Another electrical contact 52 is stationary, along with the remainder of the connector 30*a*, relative to the outer housing 26 after assembly. Thus, there is relative rotation between the electrical contacts 50, 52 when the explosive components 22, 24 rotate relative to the outer housing 26.

The electrical conductor 34 is electrically coupled to the electrical contact 50, and the selective firing module 32 is electrically coupled to the electrical contact 52. In this manner, the conductor 34 is electrically connected to the selective firing module 32, even though there is relative rotation between these components in the wellbore 14.

The rotary electrical connection 48 comprises an electrical contact 54 which rotates with the explosive components 22, 24. Another electrical contact 56 is stationary, along with the remainder of the connector 30*b*, relative to the outer housing 26 after assembly. Thus, there is relative rotation between the electrical contacts 54, 56 when the explosive components 22, 24 rotate relative to the outer housing 26.

The electrical conductor 34 is electrically coupled to the electrical contact 54, and the selective firing module 32 is electrically coupled to the electrical contact 56. In this manner, the conductor 34 is electrically connected to the selective firing module 32, even though there is relative rotation between these components in the wellbore 14.

The explosive component 22 in the outer housing 26 is explosively coupled to the explosive component 40 in the connector 30*a* by a rotary detonation coupling 58. The rotary detonation coupling 58 transfers detonation from the explosive component 40 to the explosive component 22 (both of which are detonating cords in this example). For this purpose, detonation boosters 60 may be crimped onto the explosive components 22, 40 at the rotary detonation coupling 58.

The rotary detonation coupling 58 allows the explosive components 22, 24, etc., to rotate relative to the outer housing 26, while the selective firing module 32 does not rotate relative to the outer housing. Detonation will transfer from the explosive component 40 to the explosive component 22, even though there may be relative rotation between the boosters 60 prior to (or during) such detonation.

Note that another outer housing 26, explosive components 22, 24, eccentric weight 42, bearings 44, etc., is preferably connected to the connector 30*b*. These additional explosive components 22, 24 would be detonated when an appropriate signal is received by the selective firing module 32 in the connector 30*b*. The explosive components 22, 24 illustrated in FIG. 2 would be detonated when a separate appropriate signal is received by the selective firing module 32 in the connector 30*a*. Thus, the sets of explosive components 22, 24 in the respective outer housings 26 can be selectively and individually fired by transmitting predetermined signals to their respective selective firing modules 32.

The signals may be transmitted via any means. For example, a wireline (not shown) used to convey the well tool system 12 into the wellbore 14 could be used to conduct the signals from a remote location to one of the electrical contacts 56. As another example, a telemetry transceiver (not shown) could receive a telemetry signal (e.g., via pressure pulse, acoustic, electromagnetic, optical or other form of telemetry), and in response transmit an electrical signal to the selective firing modules 32.

Figure 3:
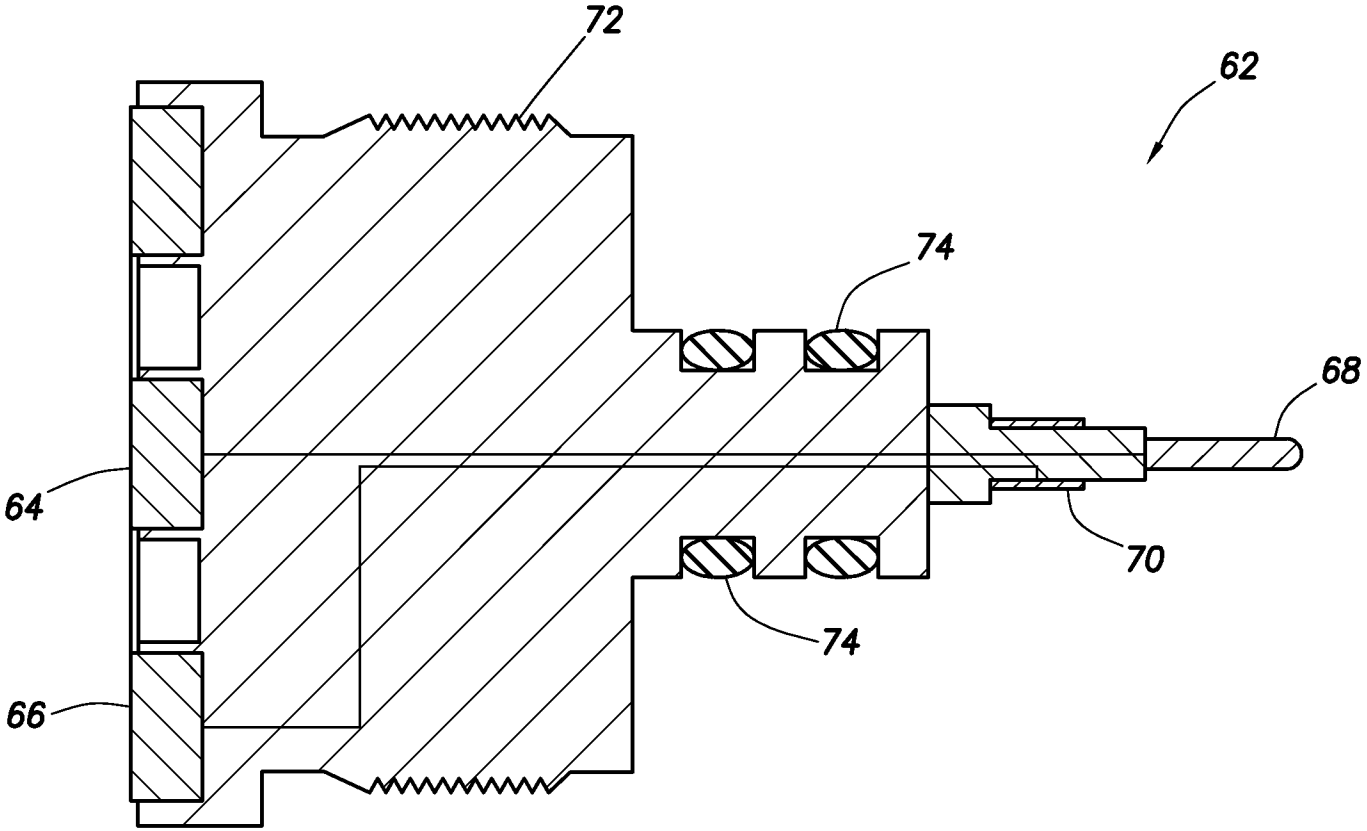
FIG. 3 is a representative cross-sectional view of an electrical coupler which may be used in the explosive assembly.

Referring additionally now to FIG. 3, an electrical coupler 62 which may be used in the explosive assembly 20 is representatively illustrated at an enlarged scale. The coupler 62 may be used in the rotary electrical connection 48, if desired, in order to pressure isolate one explosive assembly 20 from another explosive assembly which has been fired.

The electrical coupler 62 depicted in FIG. 2 includes electrical contacts 64, 66 at one end, and electrical contacts 68, 70 at another end. Contacts 64, 68 are electrically connected to each other, and contacts 66, 70 are electrically connected to each other.

Threads 72 are provided to secure the electrical coupler 62 to a connector 30. Seals 74 are provided for sealing engagement of the electrical coupler 62 in the connector 30.

Figure 4:
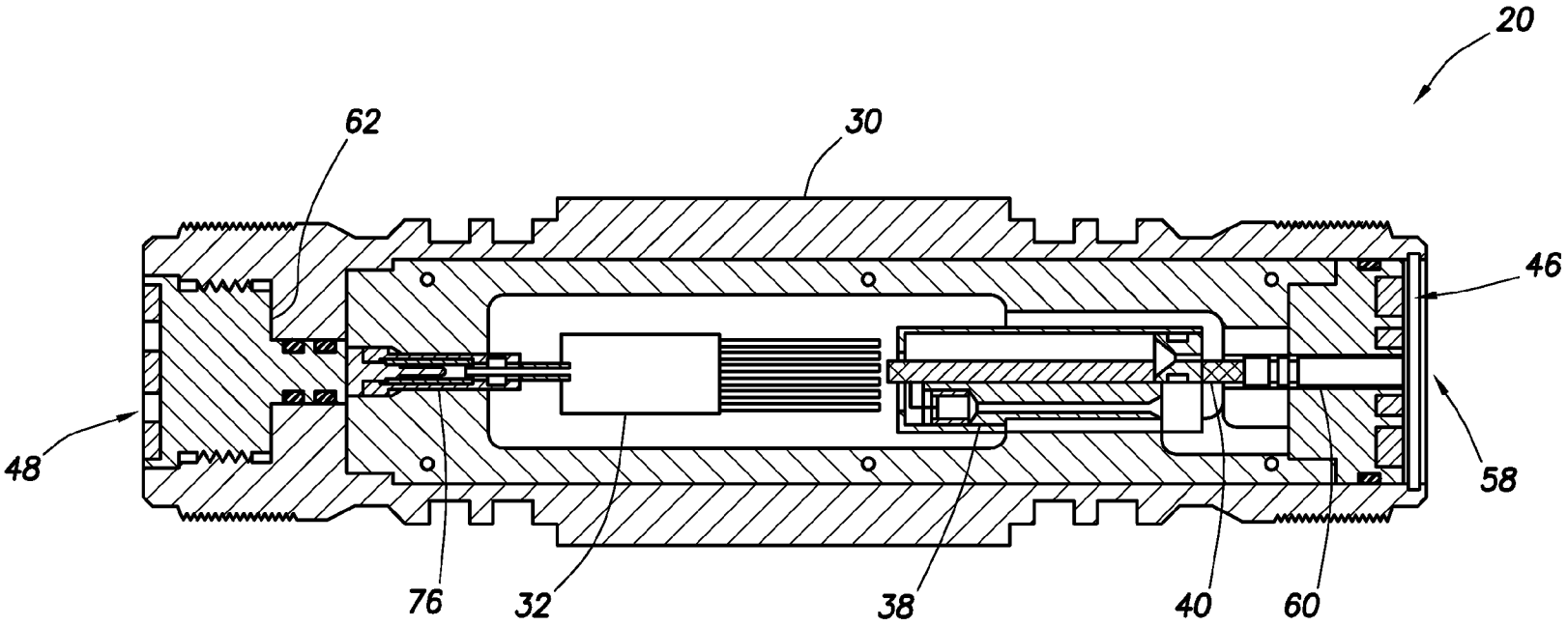
FIG. 4 is a representative cross-sectional view of a connector which may be used in the explosive assembly.

Referring additionally now to FIG. 4, the electrical coupler 62 is representatively illustrated as being installed in another configuration of the connector 30. Note that the coupler 62 is sealingly received in an end of the connector 30, so that if the explosive component 40 is detonated, pressure will not transfer to another explosive assembly 20 past the coupler 62.

Another electrical coupler 76 is electrically coupled to the selective firing module 32 in the connector 30. Thus, the selective firing module 32 is electrically connected to the rotary electrical connection 48 via the mating couplers 62, 76.

Figure 5:
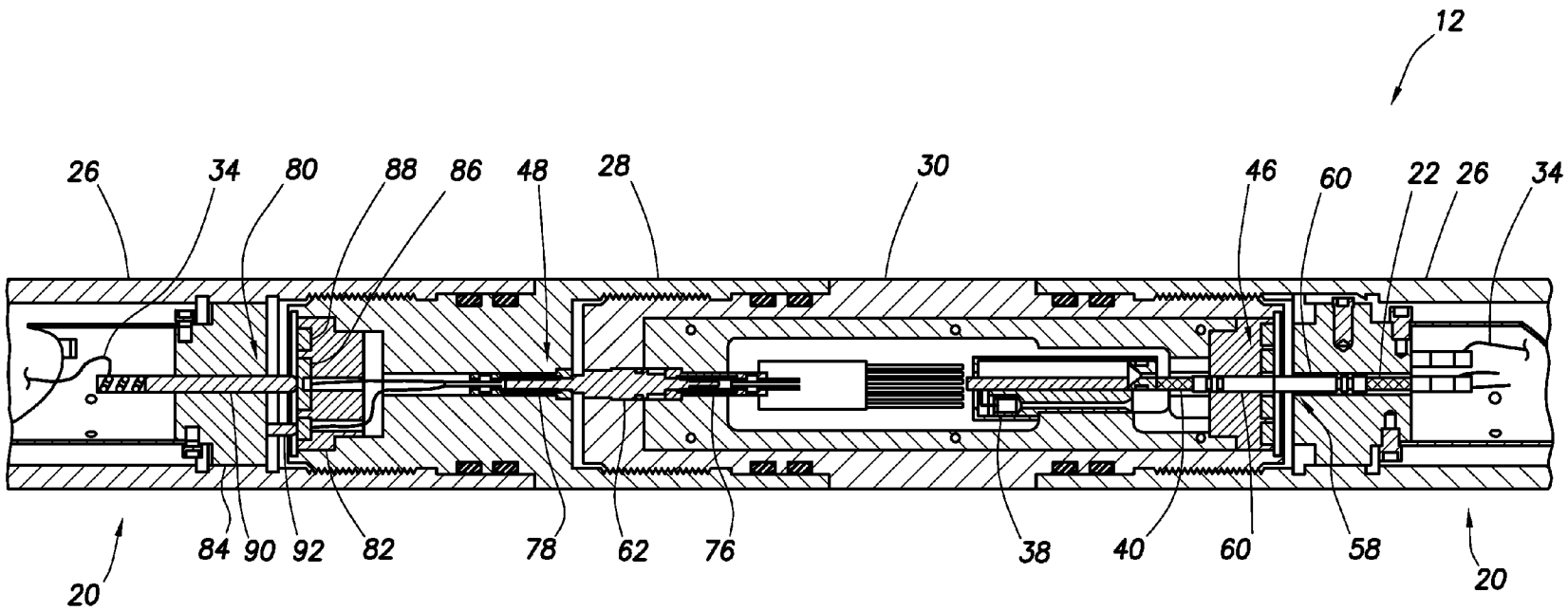
FIG. 5 is a representative cross-sectional view of a connection between multiple explosive assemblies.

Referring additionally now to FIG. 5, another configuration of the well tool system 12 is representatively illustrated. In this configuration, the rotary electrical connection 48 is made when the connectors 28, 30 of different explosive assemblies 20 are connected to each other (e.g., by threading, etc.).

This connection between the connectors 28, 30 can conveniently be performed at a well location, in order to join two explosive assemblies 20, with no need for coupling the electrical detonator 38 to the explosive component 40 in the connector 30 at the well location. However, the connectors 28, 30 could be connected to each other at a location remote from the well location, and/or the electrical connector 38 could be coupled to the explosive component 40 at the well location, and remain within the scope of this disclosure.

The electrical coupler 62 is somewhat differently configured in FIG. 5. The rotary electrical connection 48 includes an electrical coupler 78. The coupler 78 connects to the coupler 62 when the connector 30 is threaded into the connector 28.

The connector 78 is also electrically connected to a rotary electrical connection 80. The rotary electrical connection 80 includes electrical connectors 82, 84.

The electrical connector 82 includes electrical contacts 86, 88. The electrical connector 84 includes electrical contacts 90, 92 in the form of spring-loaded pins which make sliding electrical contact with the respective contacts 86, 88.

The rotary electrical connection 46 similarly includes electrical contacts and spring-loaded pins (not numbered). The rotary detonation coupling 58 is circumscribed by the electrical contacts of the rotary electrical connection 46.

Figure 6:
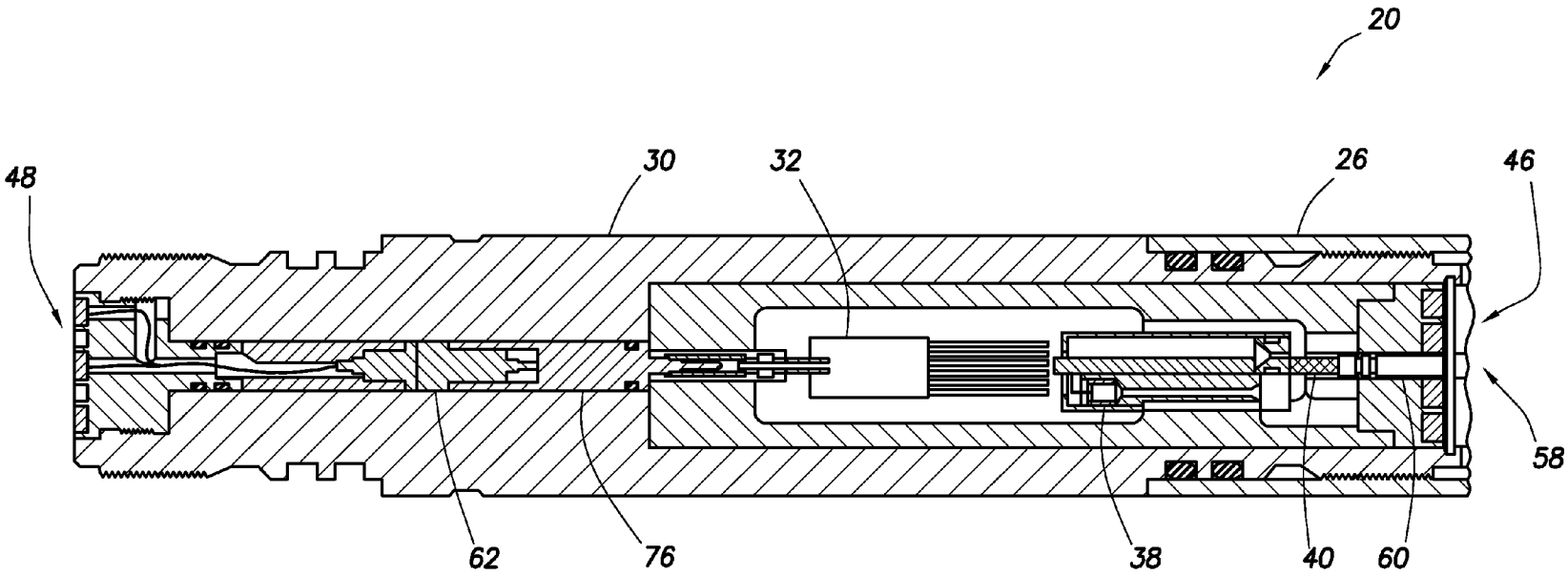
FIG. 6 is a representative cross-sectional view of another configuration of the connector.

Referring additionally now to FIG. 6, another configuration of the explosive assembly 20 is representatively illustrated. In this configuration, the coupler 62 is similar to the configuration of FIG. 3, but is longer and mates with the connector 76, which is sealingly received in the connector 30. This provides additional assurance that pressure and fluid will not be transmitted through the connector 30 between explosive assemblies 20.

Figure 7:
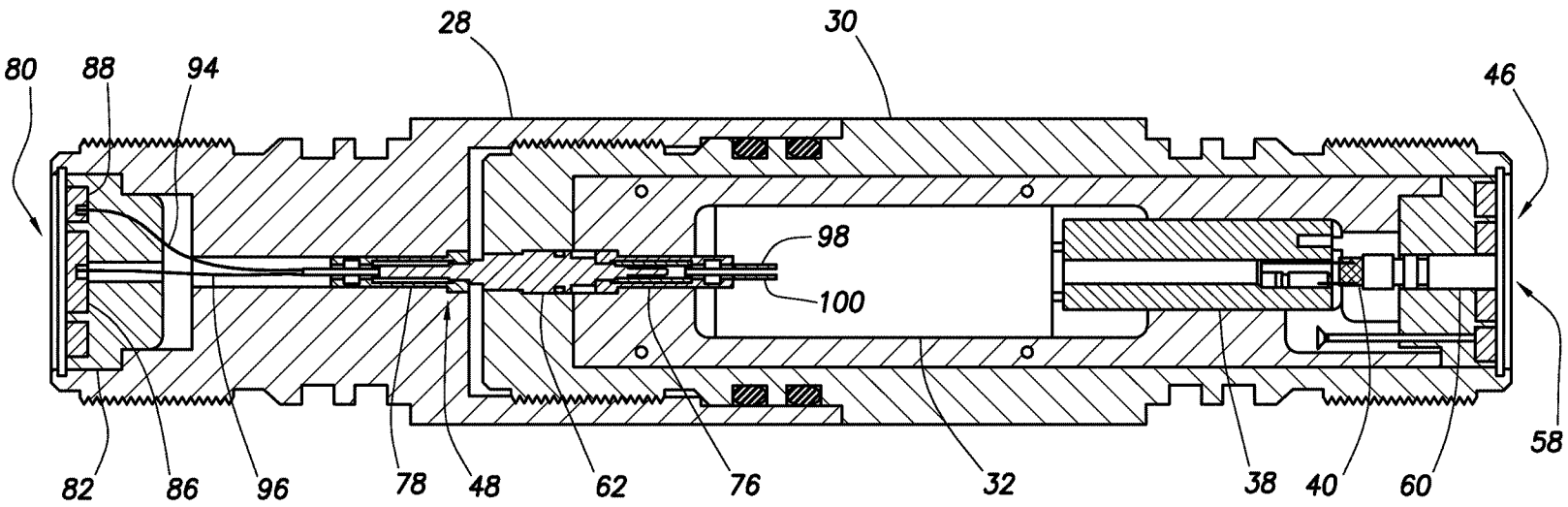
FIG. 7 is a representative cross-sectional view of another connector configuration.

Referring additionally now to FIG. 7, yet another configuration of the connectors 28, 30 is representatively illustrated. In this configuration, the rotary connection 48 is similar to that depicted in FIG. 5.

When the connectors 28, 30 are connected to each other, at least two electrical conductors 94, 96 in the connector 28 are electrically connected to at least two respective conductors 98, 100 in the connector 30. The signal may be modulated on one set of the conductors 94, 98 or 96, 100, with the other set of conductors being a ground. Alternatively, a single set of conductors could be used for transmitting the signal, with the outer housings 26 and connectors 28, 30 being used for grounding purposes (if they are made of electrically conductive materials, such as steel, etc.).

Figure 8:
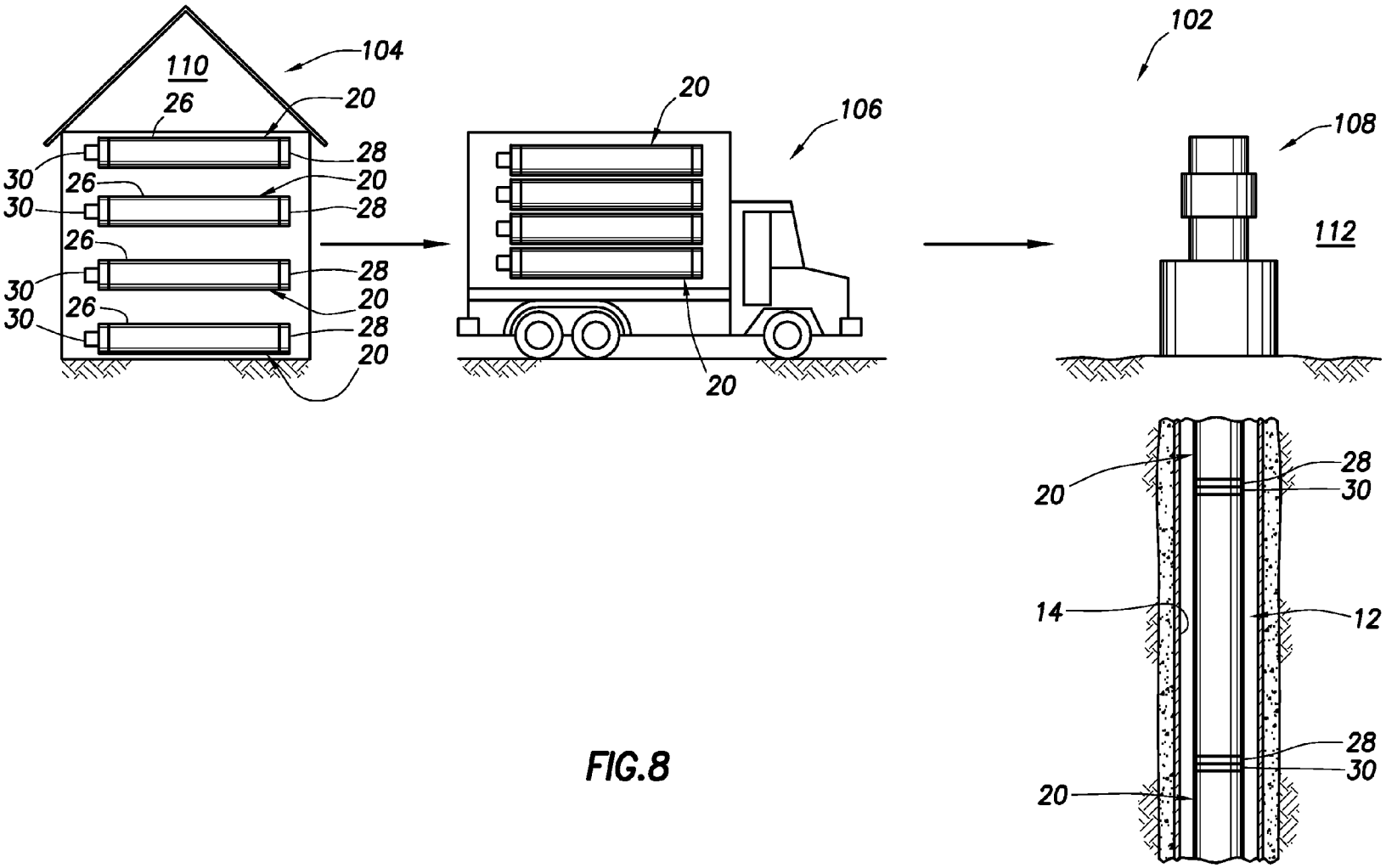
FIG. 8 is a representative illustration of steps in a method of delivering explosive assemblies to a well location, and which can embody principles of this disclosure.

Referring additionally now to FIG. 8, a method 102 for delivering the explosive assemblies 20 into the wellbore 14 is representatively illustrated. Beginning on the left-hand side of FIG. 8 an assembling step 104 is depicted, then centered in FIG. 8 a transporting step 106 is depicted, and then on the right-hand side of FIG. 8 an installing step 108 is depicted.

The assembling step 104 is preferably performed at a location 110 which is remote from a well location 112. The remote location 110 could be a manufacturing facility, an assembly shop, etc. The explosive assemblies 20 could be assembled at the remote location 110 and stored at the remote location or at another remote location (such as a warehouse, storage facility, etc.).

In the assembling step 104, preferably each of the explosive assemblies 20 is completely assembled, including coupling the electrical detonator 38 to the explosive component 40 and installing these in the connector 30 with the selective firing module 32. In this manner, the explosive assemblies 20 can be quickly and conveniently connected to each other (and/or to other assemblies, such as blank gun sections, etc.) at the well location 112, thereby reducing the time and labor needed at the well location.

A suitable electrical detonator which may be used for the electrical detonator 38 is a RED™ (Rig Environment Detonator) electrical detonator marketed by Halliburton Energy Services, Inc. The RED™ detonator does not contain primary explosives, and the detonator is insensitive to many common electrical hazards found at well locations. This feature allows many normal rig operations (such as, RF communications, welding, and cathodic protection, etc.) to continue without interruption during perforating operations.

In the transporting step 106, the explosive assemblies 20 are transported from the remote location 104 to the well location 112. While being transported, the electrical detonators 38 are preferably coupled to the respective explosive components 40 in the respective connectors 30.

In the installing step 108, the explosive assemblies 20 are conveyed into the wellbore 14 as sections of the well tool system 12. The explosive assemblies 20 may be connected to each other and/or to other assemblies in the well tool system 12.

After installation in the wellbore 14, appropriate signals are selectively transmitted to the respective selective firing modules 32. The explosive components 22, 24, 40 of each explosive assembly 20 are detonated in response to the associated selective firing module 32 receiving its predetermined signal (e.g., including the module's unique IP address, etc.).

Although each selective firing module 32 is depicted in the drawings as being associated with a single outer housing 26 with explosive components 22, 24 therein, it should be understood that in other examples a selective firing module could be associated with multiple outer housings with explosive components therein (e.g., a single selective firing module could be used to detonate more than one perforating gun, etc.) and more than one selective firing module could be used with a single outer housing and explosive components therein (e.g., for redundancy, etc.).

Figure 9:
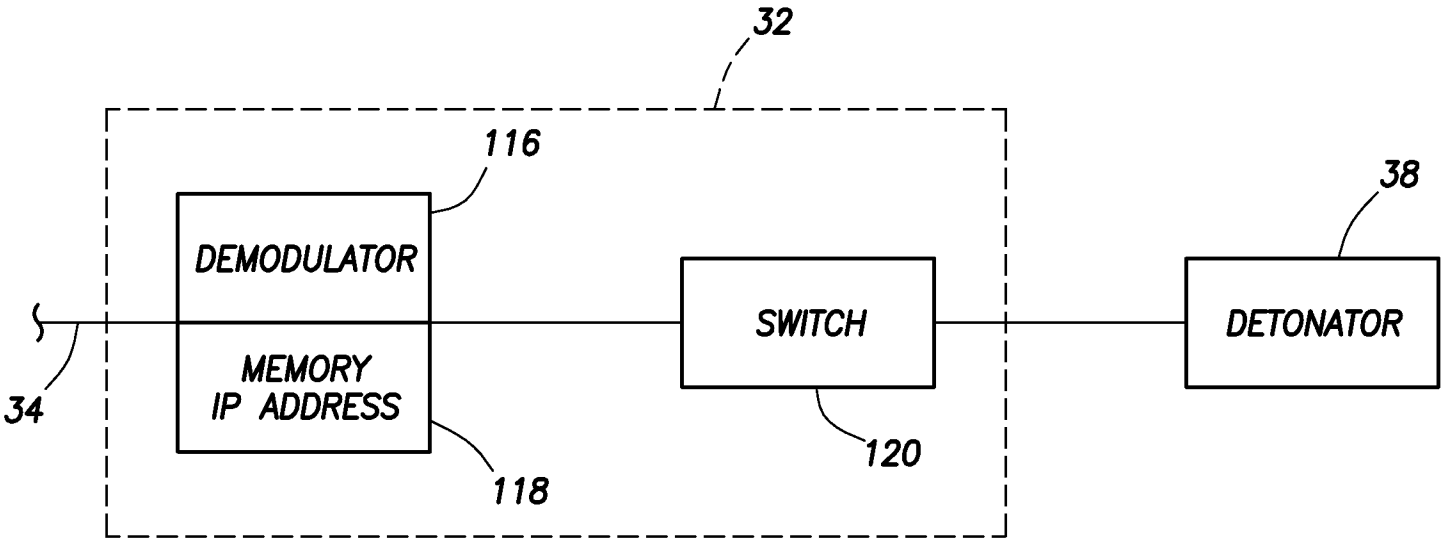
FIG. 9 is a representative block diagram for a selective firing module and electrical detonator which may be used in the connector.

Referring additionally now to FIG. 9, a schematic block diagram for the selective firing module 32 is representatively illustrated. The selective firing module 32 is depicted as being electrically connected to the electrical conductor 34 and the electrical detonator 38.

The selective firing module 32 includes a demodulator 116, a memory 118 and a switch 120. Electrical power for the selective firing module 32 may be provided via the conductor 34, or from a downhole battery or electrical generator (not shown).

The demodulator 116 demodulates the signals transmitted via the conductor 34. If the signal matches the predetermined signal stored in the memory 118, the switch 120 is closed to thereby transmit electrical power to the electrical detonator 38. This causes detonation of the explosive component 40 and the other explosive components 22, 24 coupled by the rotary detonation coupling 58 to the explosive component 40.

It may now be fully appreciated that this disclosure provides several advancements to the art. The internally oriented explosive components 22, 24 can be detonated using the selective firing module 32 which does not rotate relative to the outer housing 26. The explosive assemblies 20 can be quickly and conveniently interconnected in the well tool system 12 and installed in the wellbore 14.

The above disclosure describes a well tool system 12 which can include multiple explosive assemblies 20. Each explosive assembly 20 can include: (a) an outer housing 26, (b) at least one explosive component 22, 24 which rotates relative to the outer housing 26 when the explosive assembly 20 is installed in a well, and (c) a selective firing module 32 which causes detonation of the explosive component 22, 24 in response to a predetermined signal associated with the selective firing module 32.

Each explosive component 22, 24 may rotate relative to the respective selective firing module 32.

The explosive components 24 may comprise perforating charges. The explosive components 22 may comprise detonating cords.

The selective firing modules 32 can be non-rotatable relative to the respective outer housings 26 when the explosive assemblies 20 are installed in a well.

Each explosive assembly 20 can also include a rotary detonation coupling 58 between the selective firing module 32 and the explosive component 22, 24.

Each explosive assembly 20 can include a rotary electrical connection 46, 48 coupled to the selective firing module 32. The rotary electrical connection 48 may electrically connect the selective firing module 32 of one of the explosive assemblies 20 to another of the explosive assemblies 20. The rotary electrical connection 46 may electrically connect the selective firing module 32 to an electrical conductor 34 extending along the respective explosive assembly 20. Each explosive assembly 20 can also include a rotary detonation coupling 58.

Also provided to the art above is a method 102 of delivering a well tool system 12 into a wellbore 14 at a well location 112. The method 102 can include assembling multiple explosive assemblies 20 at a location 110 remote from the well location 112, with the assembling comprising: (a) installing an electrical detonator 32 and a first explosive component 40 in a connector 30, and (b) connecting the connector 30 to an outer housing 26; and then transporting the explosive assemblies 20 from the remote location 110 to the well location 112.

The assembling 104 can also include: (c) containing a second explosive component 22, 24 within the outer housing 26, and (d) forming a rotary detonation coupling 58 between the first and second explosive components 40 and 22, 24.

The method 102 may include, after the transporting step 106, interconnecting the explosive assemblies 20 and installing the explosive assemblies 20 in the wellbore 14, the interconnecting and installing steps 108 being performed without making a detonation coupling between the electrical detonators 38 and the respective first explosive components 40.

The assembling step 104 may include making a detonation coupling between the electrical detonator 38 and the first explosive component 40.

Each explosive assembly 20 can include a second explosive component 22, 24 which rotates within the outer housing 26 as the explosive assemblies 20 are being installed in the wellbore 14. There may be relative rotation between the first and second explosive components 40 and 22, 24 as the explosive assemblies 20 are being installed in the wellbore 14.

The assembling 104 may include installing a selective firing module 32 in the connector 30. Each explosive assembly 20 may include a rotary electrical connection 46, 48 coupled to the selective firing module 32.

Each rotary electrical connection 46 may comprise first and second rotary electrical couplers 62, 78, at least one of the first and second rotary electrical couplers 62, 78 being sealed and thereby preventing fluid flow through the respective connector 30.

The method 102 may also include, for each of the explosive assemblies 20: transmitting a predetermined signal associated with the selective firing module 32, thereby causing detonation of the respective first explosive component 40.

The disclosure above also describes a well perforating method which can include assembling multiple perforating guns (e.g., explosive assemblies 20), each perforating gun comprising an outer gun body (e.g., outer housing 26), at least one perforating charge (e.g., explosive component 24) which rotates relative to the outer gun body, and a selective firing module 32 which causes detonation of the perforating charge in response to a predetermined signal associated with the selective firing module 32. The perforating guns are installed in a wellbore 14, with the perforating charge of each perforating gun rotating relative to the respective outer gun body during installation.

The installing may also include each perforating charge rotating relative to the respective selective firing module 32.

The selective firing modules 32 may be non-rotatable relative to the respective outer gun bodies during installing the perforating guns in the wellbore 14.

Each perforating gun may also include a rotary detonation coupling 58 between the selective firing module 32 and the perforating charge.

Each perforating gun can include a rotary electrical connection 46, 48 coupled to the selective firing module 32. The rotary electrical connection 48 may electrically connect the selective firing module 32 of one of the perforating guns to another of the perforating guns. The rotary electrical connection 46 may electrically connect the selective firing module 32 to an electrical conductor 34 extending along the respective perforating gun. Each perforating gun may also include a rotary detonation coupling 58.

The assembling 104 can include containing an electrical detonator 38 and an explosive component 40 in a connector 30, and connecting the connector 30 to the outer gun body.

The method can include after the assembling 104, transporting 106 the perforating guns to a well location 112.

The method can include, for each of the perforating guns: transmitting a predetermined signal associated with the selective firing module 32, thereby causing detonation of the respective perforating charge.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well tool system, comprising:

an explosive assembly, comprising:

an outer housing;

first and second explosive components that are rotatable relative to the outer housing;

a third explosive component explosively coupled to the second explosive component;

a selective firing module which causes detonation of the first, second, and third explosive components in response to receiving a predetermined signal associated with the selective firing module;

a rotary detonation coupling comprising first and second detonation boosters located between the selective firing module and the second explosive component; and a rotary electrical connection coupled to the selective firing module and comprising an electrical contact, wherein the electrical contact is rotatable with the second explosive component when the second explosive component rotates relative to the outer housing.

2. The well tool system of claim 1, wherein the first detonation booster is coupled to the second explosive component, and the second detonation booster is coupled to the third explosive component.

3. The well tool system of claim 1, wherein the first explosive component comprises a perforating charge and each of the second and third explosive components comprises a detonating cord.

4. The well tool system of claim 1, wherein the selective firing module is non-rotatable relative to the outer housing.

5. The well tool system of claim 1, wherein the third explosive component is non-rotatable relative to the outer housing.

6. The well tool system of claim 1, wherein the explosive assembly further comprises an electrical detonator located between the selective firing module and the third explosive component.

7. A well tool system, comprising:

an explosive assembly comprising:

an outer housing; first and second explosive components that are rotatable relative to the outer housing;

a third explosive component non-rotatable relative to the outer housing and explosively coupled to the second explosive component;

a selective firing module which causes detonation of the first, second, and third explosive components in response to receiving a predetermined signal associated with the selective firing module; and a rotary electrical connection coupled to the selective firing module and comprising an electrical contact, wherein the electrical contact is rotatable with the second explosive component when the second explosive component rotates relative to the outer housing.

8. The well tool system of claim 7, further comprising two of the explosive assemblies coupled together, and wherein the rotary electrical connection electrically connects the selective firing module of one of the explosive assemblies to another of the explosive assemblies.

9. The well tool system of claim 7, further comprising two of the explosive assemblies coupled together, and wherein the rotary electrical connection electrically connects the selective firing module to an electrical conductor extending along the respective explosive assembly.

10. The well tool system of claim 7, wherein each explosive assembly further comprises a rotary detonation coupling comprising first and second detonation boosters located between the selective firing module and the second explosive component.

11. The well tool system of claim 10, wherein the first detonation booster is coupled to the second explosive component, and the second detonation booster is coupled to the third explosive component.

12. The well tool system of claim 7, wherein the selective firing module is non-rotatable relative to the outer housing.

13. The well tool system of claim 7, wherein the first explosive component comprises a perforating charge and each of the second and third explosive components comprises a detonating cord.

14. The well tool system of claim 7, wherein each explosive assembly further comprises an electrical detonator located between the selective firing module and the third explosive component.

15. A method of assembling a well tool system, comprising:

assembling multiple explosive assemblies at a location remote from a well location, the assembling comprising:

installing an electrical detonator and a first explosive component in a connector, wherein the first explosive component comprises a detonating cord;

connecting the connector to an outer housing containing a second explosive component, wherein the second explosive component comprises a perforating charge and another detonating cord; and forming a rotary detonation coupling comprising first and second detonation boosters located between the first and second explosive components, wherein the rotary detonation coupling permits the first explosive component to rotate relative to the second explosive component after the connector and the outer housing are interconnected; and then transporting the explosive assemblies from the remote location to the well location, wherein each explosive assembly further comprises a rotary electrical connection coupled to a selective firing module, and wherein at least one electrical contact of the rotary electrical connection rotates with the second explosive component when the second explosive component rotates relative to the outer housing.

16. A method of assembling a well tool system, comprising:

assembling multiple explosive assemblies at a location remote from a well location, the assembling comprising:

installing an electrical detonator and a first explosive component in a connector, wherein the first explosive component comprises a detonating cord;

connecting the connector to an outer housing containing a second explosive component, wherein the second explosive component comprises a perforating charge and another detonating cord; and forming a rotary detonation coupling comprising first and second detonation boosters located between the first and second explosive components; and then transporting the explosive assemblies from the remote location to the well location, wherein each explosive assembly further comprises a rotary electrical connection coupled to a selective firing module, and wherein at least one electrical contact of the rotary electrical connection rotates with the second explosive component when the second explosive component rotates relative to the outer housing.

17. A method of assembling a well tool system, comprising:

assembling multiple explosive assemblies at a location remote from a well location, the assembling comprising:

installing a selective firing module, an electrical detonator, and a first explosive component in a connector, wherein the first explosive component comprises a detonating cord;

connecting the connector to an outer housing, the outer housing containing a second explosive component that is rotatable relative to the outer housing, wherein the second explosive component comprises a perforating charge and another detonating cord; and forming a rotary detonation coupling comprising first and second detonation boosters located between the first and second explosive components; and then transporting the explosive assemblies from the remote location to the well location, wherein each explosive assembly further comprises a rotary electrical connection coupled to the selective firing module, and wherein at least one electrical contact of the rotary electrical connection rotates with the second explosive component when the second explosive component rotates relative to the outer housing.

18. The method of claim 17, wherein each rotary electrical connection comprises first and second rotary electrical couplers, at least one of the first and second rotary electrical couplers being sealed and thereby preventing fluid flow through the respective connector.

19. A well perforating method, comprising:

assembling multiple perforating guns, each perforating gun comprising:

an outer gun body;

a perforating charge and a detonating cord that are rotatable relative to the outer gun body;

a selective firing module which causes detonation of the perforating charge in response to receiving a predetermined signal associated with the selective firing module; and a rotary detonation coupling comprising first and second detonation boosters located between the selective firing module and the perforating charge; and installing the perforating guns in a wellbore, the perforating charge of each perforating gun rotating relative to the respective outer gun body during the installing, wherein the perforating gun further comprises a rotary electrical connection coupled to the selective firing module, and wherein at least one electrical contact of the rotary electrical connection rotates with the detonating cord when the detonating cord rotates relative to the outer gun body.

20. A well perforating method, comprising:

assembling multiple perforating guns, each perforating gun comprising:

an outer gun body;

a perforating charge and a detonating cord that are rotatable relative to the outer gun body;

a selective firing module and another detonating cord that are non-rotatable relative to the outer gun body and cause detonation of the perforating charge in response to receiving a predetermined signal associated with the selective firing module; and a rotary electrical connection coupled to the selective firing module and comprising at least one electrical contact that rotates with the detonating cord when the detonating cord rotates relative to the outer gun body; and installing the perforating guns in a wellbore, the perforating charge of each perforating gun rotating relative to the respective outer gun body during the installing.

21. The method of claim 20, wherein the rotary electrical connection electrically connects the selective firing module of one of the perforating guns to another of the perforating guns.

22. The method of claim 20, wherein the rotary electrical connection electrically connects the selective firing module to an electrical conductor extending along the respective perforating gun.

23. The method of claim 20, wherein each perforating gun further comprises a rotary detonation coupling comprising first and second detonation boosters located between the selective firing module and the perforating charge.

* * * * *